US005281999A

United States Patent [19]

Edmunds

[11] Patent Number: 5,281,999

[45] Date of Patent: Jan. 25, 1994

[54] MODULAR HIGHLIGHT COLOR AND PROCESS COLOR PRINTING MACHINE

[75] Inventor: Cyril G. Edmunds, Webster, N.Y.

[73] Assignee: Xerox Corporation, Stamford, Conn.

[21] Appl. No.: 933,854

[22] Filed: Aug. 24, 1992

[51] Int. Cl.[5] ..... G03G 21/00; G03G 15/01

[52] U.S. Cl. ..... 355/202; 355/327; 355/328

[58] Field of Search ..... 355/202, 326, 327, 328, 355/260; 346/157

[56] References Cited

U.S. PATENT DOCUMENTS

| | | | |
|---|---|---|---|
| 4,403,848 | 9/1983 | Snelling | 355/327 |
| 4,470,689 | 9/1984 | Nomura et al. | 355/211 |
| 4,599,285 | 7/1986 | Haneda et al. | 430/54 |
| 4,679,929 | 7/1987 | Haneda et al. | 355/265 |
| 4,791,452 | 12/1988 | Kasai et al. | 355/326 |
| 4,791,455 | 12/1988 | Yamamoto et al. | 355/303 |
| 4,809,038 | 2/1989 | Yamamoto et al. | 355/327 |
| 4,833,503 | 5/1989 | Snelling | 355/259 |
| 4,847,655 | 7/1989 | Parker et al. | 355/328 X |
| 4,866,474 | 9/1989 | Kinoshita et al. | 355/328 X |
| 4,927,724 | 5/1990 | Yamamoto et al. | 430/45 |
| 4,941,003 | 7/1990 | Takeda et al. | 346/160 |
| 4,949,125 | 8/1990 | Yamamoto et al. | 355/219 |
| 5,023,632 | 6/1991 | Yamamoto et al. | 346/157 |
| 5,066,989 | 11/1991 | Yamamoto | 355/270 |
| 5,079,115 | 1/1992 | Takashima et al. | 430/45 |

*Primary Examiner*—Fred L. Braun

[57] ABSTRACT

An electrophotographic printing machine adapted to print process color or highlight color documents. The printing machine operator selects either a color process unit or a highlight color process unit and inserts the selected unit into the printing machine. The printing machine, in conjunction with the inserted unit, prints the document corresponding to the selected unit. In this way, either a highlight color or a full color document is printed by the same printing machine.

11 Claims, 4 Drawing Sheets

MODULAR HIGHLIGHT COLOR AND PROCESS COLOR PRINTING MACHINE

This invention relates generally to an electrophotographic printing machine, and, more particularly concerns interchangeable modular units enabling the printing machine to selectively produce highlight color or process color copies.

Color reproduction has become very important in the copier industry. The customers are requiring more color copies. They expect consistently high quality at a relatively low cost. The customers need for color extends from black plus one color through high quality process color. Hereinbefore, multicolor copying was achieved by using one of three methods in a multicolor electrophotographic printing machine. One method a process color image can be produced by utilizing the Recharge, Expose, and Develop (REaD) process. In this process, light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the substractive color of one of the colors of the appropriately colored toner particles at a first development station. The photoconductive surface with the developed image thereon is recharged and re-exposed to record a latent image thereon corresponding to the substractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original. U.S. Pat. No. 4,403,848, U.S. Pat. No. 4,599,285, U.S. Pat. No. 4,679,929, U.S. Pat. No. 4,791,455, U.S. Pat. No. 4,809,038, U.S. Pat. No. 4,833,504, U.S. Pat. No. 4,927,724, U.S. Pat. No. 4,941,003, U.S. Pat. No. 4,949,125, U.S. Pat. No. 5,023,632, U.S. Pat. No. 5,066,989 and U.S. Pat. No. 5,079,155 discloses various methods of forming color copies, where a first image is formed and developed on a photoconductive surface, the steps above are repeated to superimpose a plurality of toner images on the photoconductive surface, and the toner images are transferred to a copy sheet in one step.

The REaD color process may be implemented in either of two architectures. One architecture is a single-pass single transfer, in this architecture there is provided four or three imaging stations with each consisting of a charging unit, laser device and developer unit, located around a photoconductive belt or drum. It requires one revolution of the photoconductive belt or drum to produced a color image. In the second architecture, a multi-pass single transfer there is one imaging station consisting of a charging device, a laser device and four or three developer units, located around a photoconductive belt or drum. In the multipass architecture, a color image can be produced in four or three revolutions of the photoconductive belt or drum. It is desirable to implement color in a single pass architecture for the highest productivity. However, single pass color may not be able to provide the required print quality for copies requiring relatively little color such as color forms which are printed in one or two colors (highlight color). On the other hand, a multi-pass process color machine also has low productivity for printing jobs with relatively little color.

Highlight color printing machine have high productivity for copies requiring relatively little color such as color forms which are printed in one or two colors. However, highlight color printing machine are not capable of producing a process color image. Highlight color copies can be produced by initially charging the photoconductive surface. Thereafter, the charged portion of the photoconductive surface is discharged to form an electrostatic latent image thereon. The latent image is subsequently developed with black toner particles. The photoconductive surface is then recharged and imagewise exposed to record the highlight color portions of the latent image thereon. A highlight latent image is then developed with toner particles of a color other than black, e.g. red, then developed. Thereafter, both toner powder images are transferred to a sheet and subsequently fused thereto to form a highlight color document.

It is highly desirable to provide a simple, relatively inexpensive, and accurate printing machine to provide consistent quality highlight color and process color copies. The need to provide such color copies has become more acute, as customer demand has increased.

Various techniques have been devised for producing color images as illustrated by the following disclosures, which may be relevant to certain aspects of the present invention:

U.S. Pat. No. 4,470,689;
Patentee: Nomurs et al.;
Issued: Sep. 11, 1984:
U.S. Pat. No. 4,791,452;
Patentee: Kasai et al.;
Issued: Dec. 13, 1988:

The relevant portions of the foregoing patents may be briefly summarized as follows:

U.S. Pat. No. 4,470,689 discloses a process kit removably mountable on the main body of an image formation apparatus. The process kit consist of a photoreceptor and a development unit. The process kit can be interchanged with a process kit containing toner of another color.

U.S. Pat. No. 4,791,452 discloses single-color image printing and multicolor image printing carried out by an image forming apparatus in response to color signals. The image forming apparatus includes an image carrier, a first image forming unit having a first developer wherein a first color developing agent is stored, and a second image forming unit wherein a second color developing agent is stored.

In accordance with one aspect of the present invention, there is provided an electrophotographic printing machine adapted to print process color or highlight color documents including a photoconductive member. Means are provided for recording a latent image on the photoconductive member. Means are provided for developing the latent image recorded on the photoconductive member with toner of a first color. A first operator removable unit is adapted to be positioned in an operative location associated with said photoconductive member or in a non-operative location remote from said photoconductive member. The recording means, responsive to the first operator removable unit being in the operative position, records a second latent image on the photoconductive member. The first operator removable unit develops the second latent image with toner of a second color. A second operator removable unit is interchangeable with the first operator removable unit so as to position the second operator removable in the operative position and the first removable unit in the non-operative. The second operator removable unit, in the operative position, records a third latent image on the photoconductive member. Second means are provided for developing the second latent image or the third latent image with toner of a third color.

Other aspects of the present invention will become apparent as the following description proceeds and upon reference to the drawings, in which.

While the present invention will be describe in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 5:
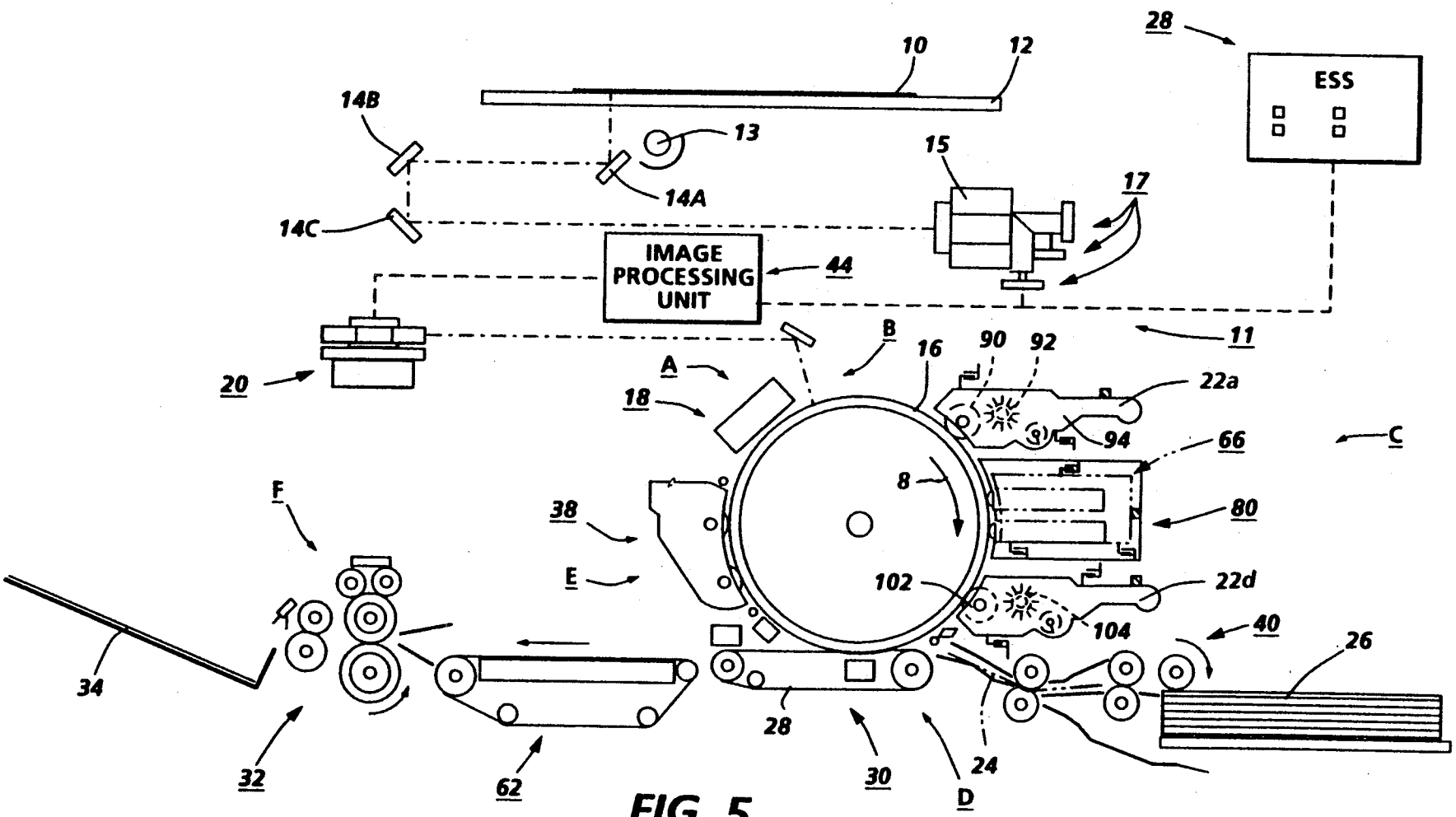
FIG. 5 is a schematic elevational view of a color print machine incorporating the features of the present invention therein.

For a general understanding of the features of the present invention, reference numerals have been used throughout to designate identical elements. FIG. 5 schematically depicts the various elements of an illustrative color electrophotographic printing machine incorporating the features of the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 5 printing machine will be shown hereinafter schematically and their operation described briefly with reference thereto.

Turning now to FIG. 5, the color printing process starts by inserting the process color unit 66 or the highlight color unit 82 into the printing machine. The operator selects the appropriate unit depending upon the type of document being printed. When a full color document is being printed, process color unit 66 is inserted into the printing machine. Alternatively, when a highlight color document is being printed, highlight color unit 82 is inserted into the printing machine. Assuming initially that a full color document is being printed, process color unit 66 is inserted into the printing machine, a computer generated color image may be inputted into image processor unit 44 or a color document 10 to be copied may be placed on the surface of a transparent platen 12. A scanning assembly having a halogen or tungsten lamp 13 is used as a light source to illuminate the color document 10. The light reflected from the color document 10 is reflected by mirrors 14*a*, 14*b* and 14*c*, through lenses (not shown) and a dichroic prism 15 to three charged-coupled devices (CCDs) 17 where the information is read. The reflected light is separated into the three primary colors by the dichroic prism 15 and the CCDs 17. Each CCD 17 outputs an analog voltage which is proportional to the strength of the incident light. The analog signal from each CCD 17 is converted into an 8-bit digital signal for each pixel (picture element) by an analog/digital converter. The digital signal enters an image processor unit 44. The output voltage from each pixel of the CCD 17 is stored as a digital signal in the image processing unit. The digital signal which represent the blue, green, and red density signals is converted in the image processing unit into four bitmaps: yellow (Y), cyan (C), magenta (M), and black (Bk). The bitmap represents the exposure value for each pixel, the color components as well as the color separation.

Photoconductive drum 16, is charged by charging unit 18. The charged portion of the photoconductive surface is advanced through imaging station B where the first color bitmap information is recorded. The scanning device is a laser raster output scanner (ROS). The ROS 20 performs the function of creating the output image copy on the photoconductive surface. It lays out the image in a series of horizontal scan lines with each line having a certain number of pixels per inch. The ROS 20 may include a laser with rotating polygon mirror blocks and a suitable modulator or, in lieu thereof, a light emitting diode array (LED) as a write bar. The electronic subsystem (ESS) 28 is the control electronics which includes the image processing unit prepares and manages the image data flow between the data source and the ROS. It also includes a display, user interface and electronic storage, i.e. memory, functions. The ESS is actually a self-contained, dedicated mini computer. The photoconductive surface, which is initially charged to a high charge potential, is discharged imagewise in the background areas and remains charged in the image areas in the colored parts of the image.

Figure 1:
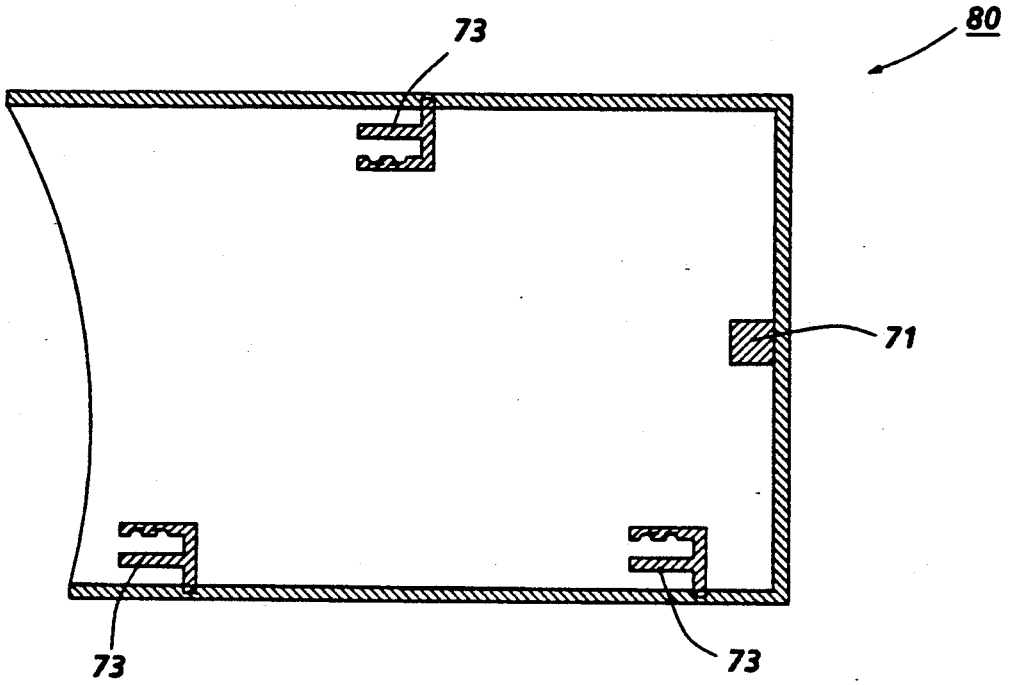
FIG. 1 is an enlarged, schematic elevational view of the FIG. 5 printing machine frame for removably supporting the FIG. 2 process color module or the FIG. 3 highlight color module.
Figure 2:
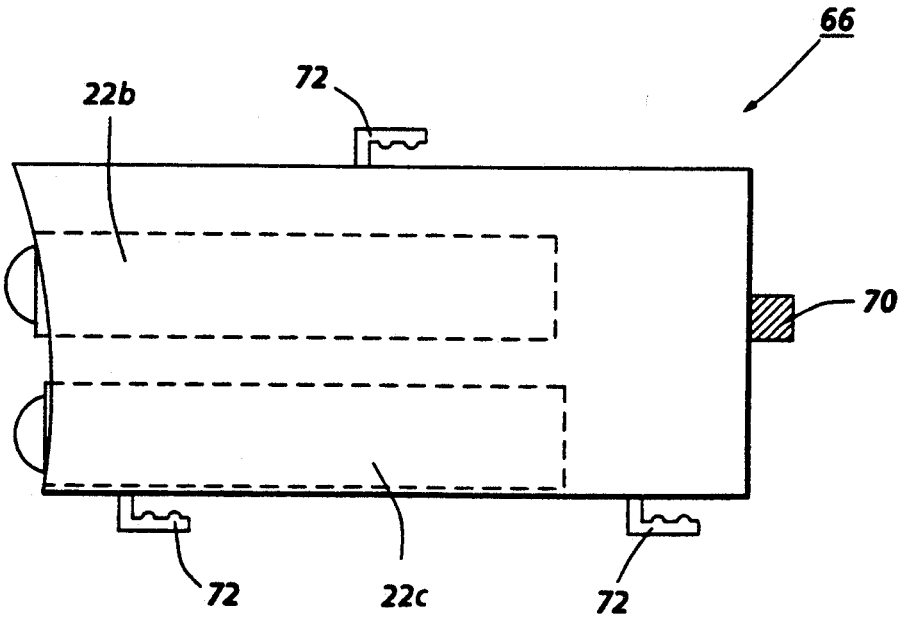
FIG. 2 is an enlarged, schematic elevational view of the process color module adapted to be removably mounted in the FIG. 1 printing machine frame.

As shown in FIG. 2, the process color unit has two removable developer units 22*b* and 22*c* which are positioned parallel to each other. Three slideable mounts 72 are positioned on the process color unit 66. Also, three slideable mounts 73 are located on the copier machine frame 80, as shown in detail in FIG. 1. The process color unit 66 is removably mounted in frame 80. A control interface 70 which supplies power and control information to process color unit 66 connects to a corresponding interface 71 located in the machine frame 80. The control interface 70 also includes a Customer Replacement User Monitor (CRUM) which communicates with ESS 28 to indicate whether unit 66 or 82 is present in frame 80 of the printing machine. This enables the printing machine to be setup for a process color unit 66 to print color documents.

At development station C, with the process color unit 66 inserted therein, there are four developer units. The first developer unit 22*a* is mounted fixedly in the printing machine frame. The fourth developer unit 22*d* is mounted removable on the machine frame. The second and third developer units 22*b* and 22*c* are mounted fixedly in process color unit 66. Process color unit 66 is mounted removably in frame 80. The first latent image is developed by charged-area development (CAD) by the first developer unit 22*a* which has a magnetic brush developer roller 90 that advances developer material into contact with the electrostatic latent image. A paddle wheel 92 picks up developer material from developer sump 94 and delivers it to the developer roller 90. In the first pass in the multi-pass color process the first developer unit 22*a* is in operation. Photoconductive drum 16 is adjacent roll 90 of the first developer unit 22*a* to form a development zone therebetween. Roll 90 advances developer material into contact with the electrostatic latent image. The latent image attracts toner particles from the carrier granules of the developer material to form a developed toner powder image on the photoconductive surface of drum 16. A toner dispenser (not shown) discharges unused toner particles into sump 94. The developer roller 90 includes a rotating sleeve (not shown) having a stationary magnetic (not shown) disposed interiorly thereof. The magnetic field generated by the magnet attracts developer material from paddle wheel 92 to the sleeve of the developer roller 90. As the sleeve rotates, it advances the developer material into the development zone where toner particles are attracted from the carrier granules to the charged area latent image. In this way, the latent image is developed with these toner particles. The toner particles being employed in developer unit 22*a* are black. Thus, the latent image is developed by developer unit 22*a* with black toner particles. The black developed latent image continues to advance with photoconductive drum 16 in the direction of arrow 8.

Drum 16 is rotated to charging station A and is recharged by charging unit 18. At imaging station B, ROS 20 superimposes a second bitmap image signal on the first developed image and the subsequent image is developed over the previous developed image by discharge-area development (DAD) with use of a second developer unit 22*b*. Developer unit 22*b* which is representative of the operation of development stations 22*c* and 22*d*, includes a donor roll 102, electrode wires (not shown) and a magnetic roll 99. The donor roll 102 can be rotated in either the (width) or (against) direction relative to the motion of drum 16. Electrode wires are located in the development zone defined as the space between photoconductive drum 16 and donor roll 102. The electrode wires include one or more thin tungsten wires which are lightly positioned against donor roll 102. The distance between wires and donor roll 102 is approximately the thickness of the toner layer on donor roll 102. An electrical bias is applied to the electrode wires by a voltage source. A voltage source electrically biases the electrode wires with both a DC potential and an AC potential. A DC voltage source establishes an electrostatic field between photoconductive drum 16 and donor roll 102. In operation, magnetic roll 104 advances developer material comprising carrier granules and toner particles into a loading zone adjacent donor roll 102. The electrical bias between donor roll 102 and magnetic roll causes the toner particles to be attracted from the carrier granules to donor roll 102. Donor roll 102 advances the toner particles to the development zone. The electrical bias on electrode wires detaches the toner particles on donor roll 102 and forms a toner powder cloud in the development zone. The latent image attracts the detached toner particles to form a toner powder image over the previous developed black image. The toner particles used in developer unit 22*b* are cyan. The drum 16 is rotated and recharged by the charging unit 18. At imaging station B, ROS 20 superimposes a third bitmap image signal by selectively discharging the recharged photoconductive surface and developer unit 22*c* develops the image with yellow toner over the two layers of previous developed toner in the same manner as mention for developing the second image. The drum 16 is rotated and recharged by charging unit 18 and ROS 20 superimposes a fourth bitmap image signal by selectively discharging the recharged photoconductive surface and developer unit 22*d* develops the image with magenta toner over three layer of previous developed toner in the same manner as mention for the development for the second and third image.

The resultant image, a multi-color image by virtue of the developing station 22*a*, 22*b*, 22*c* and 22*d* having black, yellow, magenta, cyan, toner disposed therein advances to transfer station D. It should be evident to one skilled in the art that the color of toner at each development station could be in a different arrangement. When the development process is completed, a sheet of copy paper 24 from the paper supply 26 is moved through the paper feeder 40 onto the transfer belt 28 which is cammed adjacent drum 16. The developed image and the copy paper 24 are registered and the developed latent image transferred onto the paper by a transfer unit 30, located under the transfer belt 28, which attracts the toner to the paper. The sheet of copy paper 24 moves to a fuser station 32 on a conveyor 62 where the toner is permanently affixed to the copy paper 24. The copy paper is then moved onto an output tray 34. The color copy process is completed when drum 16 is cleaned of residue toner at cleaning station 38.

Figure 3:
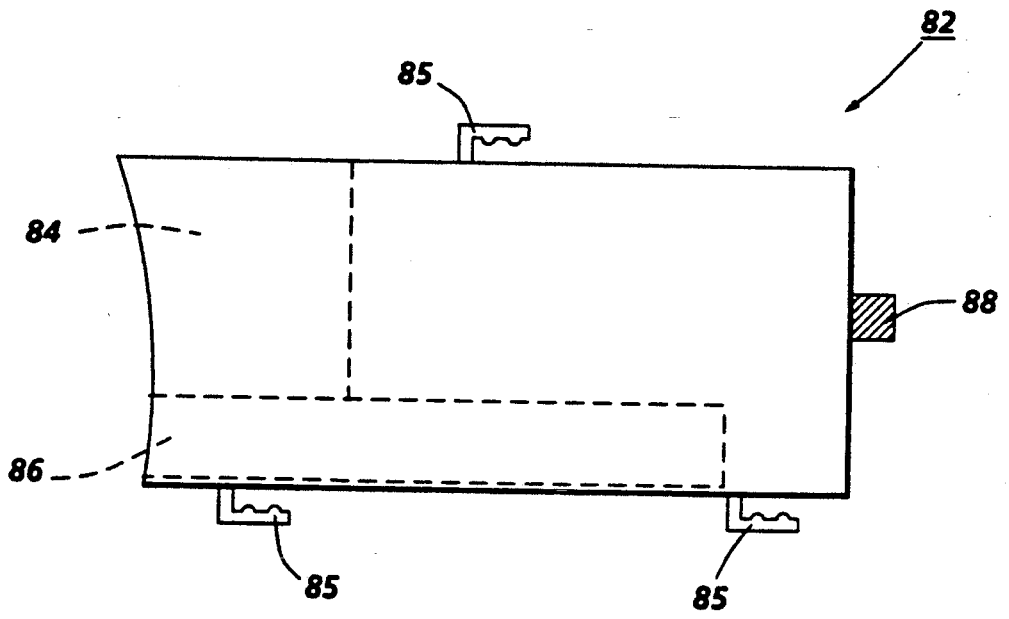
FIG. 3 is an enlarged, schematic elevational view of the highlight color module adapted to be removably mounted in the FIG. 1 printing machine frame.

Highlight color printing is initiated by the operator removing the process color unit 66 and inserting highlight color unit 82, shown in detail in FIG. 3. CRUM, located on the side of the unit, signals ESS 28 that the highlight color unit is present and to expect a highlight color image. Also, CRUM allows control panel located on top of the machine to indicate to the operator that the highlight color unit 82 is properly inserted, as well as the highlight color available. The highlight color unit 82 includes a recharger unit 84, LED image bar 86 located beneath the recharger unit 84, and slideable mounts 85 located on the side of the unit. Slideable mounts 85 mesh mounts 73 on machine frame 80 to permit highlight color unit 82 to be mounted removably in the machine. In addition, developer unit 22*d* is removed from the printing machine and replaced with a new developer unit substantially identical thereto with red rather than magenta toner particles.

Initially, a portion of the photoconductive surface passes through charging station A. At charging station A, charging unit 18, charges photoconductive drum 16 to a relatively high, substantially uniform potential. Next, the charged portion of the photoconductive surface is advanced through imaging station B. At imaging station B, the uniformly charged photoconductive surface is exposed by the ROS 20 which discharges the photoconductive surface in accordance with the output from the document placed on the platen 12 or a computer generated image inputted. The photoconductive surface, which is initially charged to a high charge potential, is discharged imagewise in the background areas and remains charged in the image areas in the black parts of the image.

At development station C, the latent image is developed by developer unit 22*a*. The toner particles being employed in developer unit 22A are black. Thus, the charged area latent image is developed by developer unit 22*a* with black toner particles. The black developed latent image continues to advance with photoconductive drum 16 in the direction of arrow 8.

Corona generator 84 recharges photoconductive surface of drum 16. A second imager, such as LED bar 86, which may for example be an ROS, illuminates the recharged photoconductive surface to selectively discharge the photoconductive surface. The photoconductive surface is discharged in the image areas and charged in the non-image areas to record a discharged latent image thereon. Thereafter, the discharged latent image is developed by a developer unit 22*d*. By way of example, the toner particles in developer unit 22*d* are red. However, they can be of any color other than black. After the charged area latent image is developed with black toner particles and the discharged area latent image developed with red toner particles, drum 16 advances the resultant toner powder image to transfer station D.

At transfer station D, a sheet of paper 24 is moved into contact with the toner powder image. The sheet of copy paper 24 from the paper supply 26 is moved by the paper feeder 40 onto transfer belt 28 which is cammed adjacent drum 16. The developed image and the copy paper 24 are registered. The developed image is then transferred from drum 16 to paper 24 by a transfer unit 30, located under the transfer belt 28. Thereafter, the sheet of copy paper 24 moves to a fuser station 32 on conveyor 62 where the toner is permanently affixed to copy paper 24. Copy paper then moves onto an output tray 34. The highlight color copy process is completed when residue toner is cleaned from drum 16 at cleaning station 38.

Figure 4:
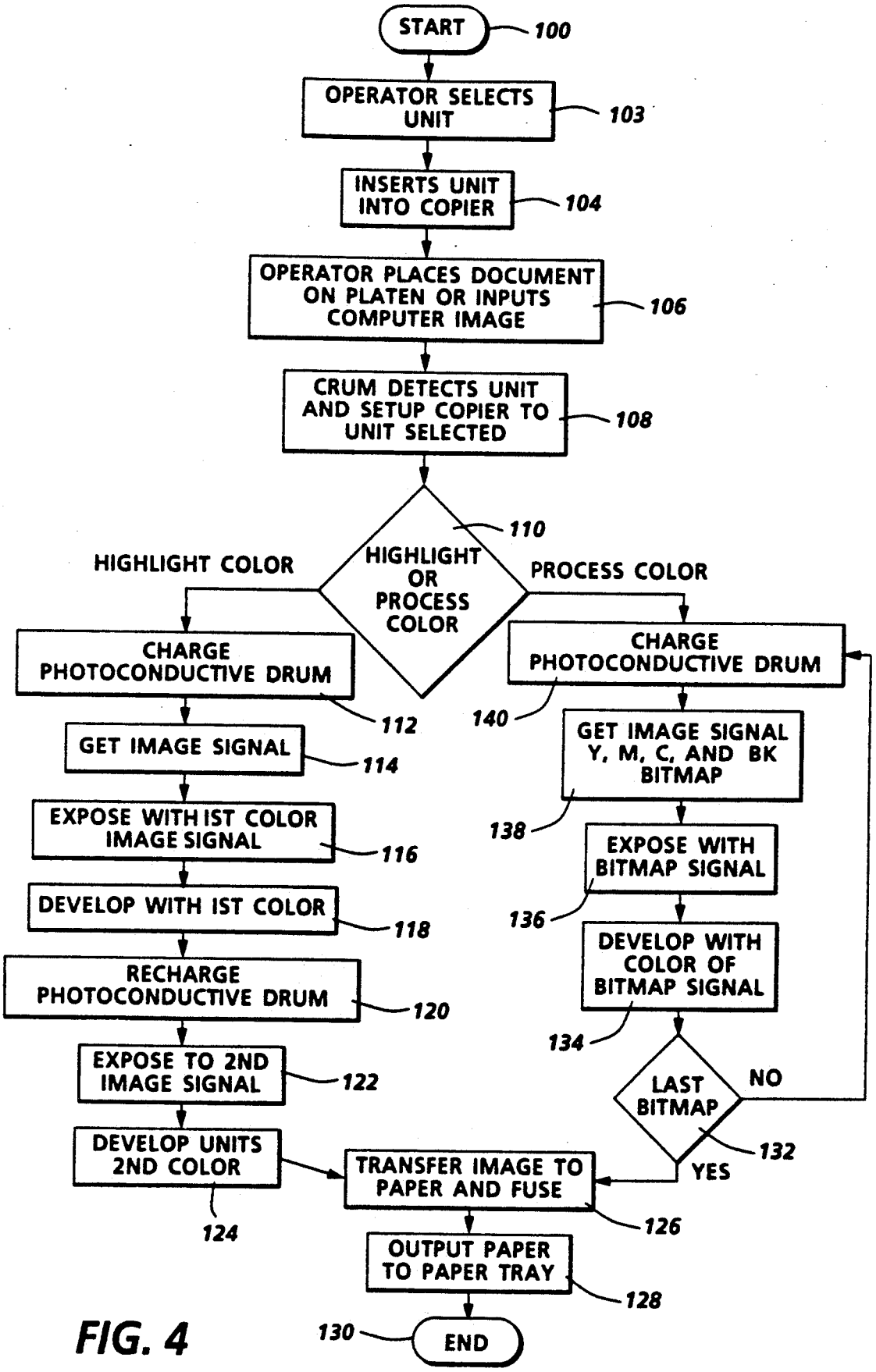
FIG. 4 is a flow diagram illustrating the operation of the FIG. 5 printing machine for highlight color and process color printing.

Referring now to FIG. 4, FIG. 4 is a flow diagram illustrating the operation of the printing machine for highlight color and process color printing. The process starts at step 100 by the operator selecting the highlight color or process color unit at step 103. The operator inserts the selected unit into the copier at step 104. The operator places a document to be copied on the platen of the copier or inputs a computer image into the copier at step 106. At step 108, the CRUM detects the unit being inserted and the copier electronics is setup to the appropriate values according to the unit selected at step 103. If the CRUM detects the highlight color unit at step 110 then the copier electronics is setup for highlight color. The photoconductive drum is charged at step 112 whereupon it is selectively exposed at step 116 in accordance with a first image signal received from step 114. The latent image produced at step 116 is developed within a first color at step 118. The photoconductive drum is recharged at step 120 and exposed to a second image signal at step 122 to produce a color highlight latent image. The second developer unit develops the latent image at step 124 with a second color toner creating a highlight color image. The highlight color image is transferred to a sheet of copy paper and fused thereto at step 126. The highlighted color sheet is transported to an output tray at step 128. The process end at step 130.

However, if the CRUM detects the process color unit at step 108 then the copier electronics is setup for process color. The photoconductive drum is charged at step 140. The photoconductive drum is selectively exposed at step 136 in accordance with an image bitmap signal received in step 138. The latent image is developed at step 134 with toner of a color corresponding to the color of the bitmap image signal of step 138. At step 132 the ESS determines if the last bitmap has been developed, if not, the photoconductive drum is charged at step 140 and selectively exposed at step 136 by superimposing a second bitmap image from step 138 over the first developed image. The second image is developed with toner of a second color at step 134. The third and fourth colors are exposed and developed by repeating steps 140, 138, 136 and 134, respectively for each color. When the last bitmap is developed at step 132 the process color image is transferred and fused to a sheet of copy paper at step 126. At step 128, the sheet with the multicolor image is transported to a paper tray at step 128. The process ends at step 130.

In recapitulation, an electrophotographic printing machine of the present invention is adapted to print process color and highlight color documents. The machine operator selects either a highlight color module or a process color module and inserts the selected module into the printing machine. The selected module in conjunction with the other processing stations of the printing machine prints either a full color document or a highlight color document.

It is, therefore, evident that there has been provided, in accordance with the present invention an electrophotographic printing machine that is adapted to print either highlight color or process prints. This printing machine fully satisfies the aims and advantages hereinbefore set forth. While, this invention has been described in conjunction with a specific embodiment thereof, it is evident that many alternative, modifications and variations will be apparent to those skilled in the art. Accordingly, it is intended to embrace all such alternatives, modification and variations as fall within the spirit and broad scope of the appended claims.

I claim:

1. An electrophotographic printing machine adapted to print process color or highlight color documents, including:

a photoconductive member;

means for recording a first latent image on said photoconductive member;

first developer means for developing the first latent image recorded on said photoconductive member with toner of a first color;

a first operator removable unit adapted to be positioned in an operative location associated with said photoconductive member or in a non-operative location remote from said photoconductive member, said recording means, responsive to said first operator removable unit being in the operative position, recording a second latent image on said photoconductive member, said first operator removable unit developing the second latent image with toner of a second color;

a second operator removable unit, interchangeable with said first operator removable unit so as to position said second operator removable unit in the operative position and said first removable unit in the non-operative position with said second operator removable unit, in the operative position, recording a highlight color latent image on said photoconductive member; and second developer means responsive to said second operator removable unit being in the operative position, for developing the highlight color latent image with toner of a highlight color.

2. A printing machine according to claim 1, further including means for moving said photoconductive member through a plurality of cycles, said recording means recording the first latent image on said photoconductive member during a first cycle and the second latent image thereon during a second cycle.

3. A printing machine according to claim 2, wherein said recording means, responsive to said first operator removable unit being in the operative position, records a third latent image on said photoconductive member during a third cycle.

4. A printing machine according to claim 3, further including third developer means, interchangeable with said second developer means so as to position said third developer means in the operative position and said second developer means in the non-operative position, for developing the third latent image with toner of a third color, said third developer means being in the operative position in response to said first operator removable unit being in the operative position.

5. A printing machine according to claim 4, wherein said first operator removable unit includes a developer unit.

6. A printing machine according to claim 1, further including means for moving said photoconductive member through a plurality of cycles, said recording means recording the first latent image on said photoconductive member during a first cycle, and said second operator removable unit recording the highlight color latent image on said photoconductive member during the first cycle.

7. A printing machine according to claim 6, wherein said second operator removable unit includes:

a charging unit adapted to charge said photoconductive member in response to said first developer means developing the first latent image recorded on said photoconductive member; and means for selectively discharging said photoconductive member, in response to said charging unit charging said photoconductive member, to record the highlight color latent image on said photoconductive member.

8. A printing machine according to claim 7, wherein said discharging means includes a laser unit.

9. A printing machine according to claim 1, wherein said first developer means develops the first latent image with black toner.

10. A printing machine according to claim 9, wherein said first operator removable unit develops the second latent image with toner selected from the group consisting of cyan toner, magenta toner, and yellow toner.

11. A printing machine according to claim 9, wherein said second developer means develops the highlight color latent image with toner selected the group consisting of red toner, blue toner, and green toner.

* * * * *